US006644960B2

(12) United States Patent
Tomolillo et al.

(10) Patent No.: US 6,644,960 B2
(45) Date of Patent: Nov. 11, 2003

(54) DEVICE FOR SUPPLYING FUEL AND COMBURENT TO ONE OR MORE ARRAYS OF BURNERS

(75) Inventors: Marcello Tomolillo, Genoa (IT); Massimiliano Fantuzzi, Genoa (IT)

(73) Assignee: Techint Compagnia Tecnica Internazionale (IT)

( * ) Notice: Subject to any disclaimer, the term of this patent is extended or adjusted under 35 U.S.C. 154(b) by 0 days.

(21) Appl. No.: 10/203,371

(22) PCT Filed: Feb. 14, 2001

(86) PCT No.: PCT/EP01/01598

§ 371 (c)(1),
(2), (4) Date: Aug. 9, 2002

(87) PCT Pub. No.: WO01/67000

PCT Pub. Date: Sep. 13, 2001

(65) Prior Publication Data

US 2003/0031965 A1 Feb. 13, 2003

(30) Foreign Application Priority Data

Feb. 14, 2001 (IT) ..... GE00A0034

(51) Int. Cl.[7] ..... F23Q 9/08
(52) U.S. Cl. ..... 431/281; 431/60
(58) Field of Search ..... 431/281, 60, 12

(56) References Cited

U.S. PATENT DOCUMENTS 3,760,775 A * 9/1973 Williams
4,043,742 A * 8/1977 Egan et al.
4,614,491 A * 9/1986 Welden ..... 431/60
4,640,677 A * 2/1987 Huber ..... 431/89
4,825,353 A * 4/1989 Jenkins
4,834,644 A * 5/1989 Snow
5,931,652 A * 8/1999 Epworth ..... 431/3

FOREIGN PATENT DOCUMENTS

JP 57157931 A * 9/1982

* cited by examiner

*Primary Examiner*—Alfred Basichas
(74) *Attorney, Agent, or Firm*—Larson & Taylor, PLC

(57) ABSTRACT

A device for supplying one or more arrays (1, 2) of burners (3), in which each burner (3) comprises at least one fuel inlet line (302) and at least one comburent agent inlet line (301). The said lines (302, 301) of the burners (3) are connected upstream respectively to at least one fuel supply duct (13) and to at least one comburent agent supply duct (9), and means (10, 11, 13, 16) are provided for monitoring and controlling the flows of fuel and comburent agent in these supply ducts. These means are operationally connected to at least one central unit (17) for controlling the distribution of the said flows to the arrays (1, 2) of burners (3)A device for supplying one or more arrays (1, 2) of burners (3).

1 Claim, 1 Drawing Sheet

DEVICE FOR SUPPLYING FUEL AND COMBURENT TO ONE OR MORE ARRAYS OF BURNERS

Figure 1:
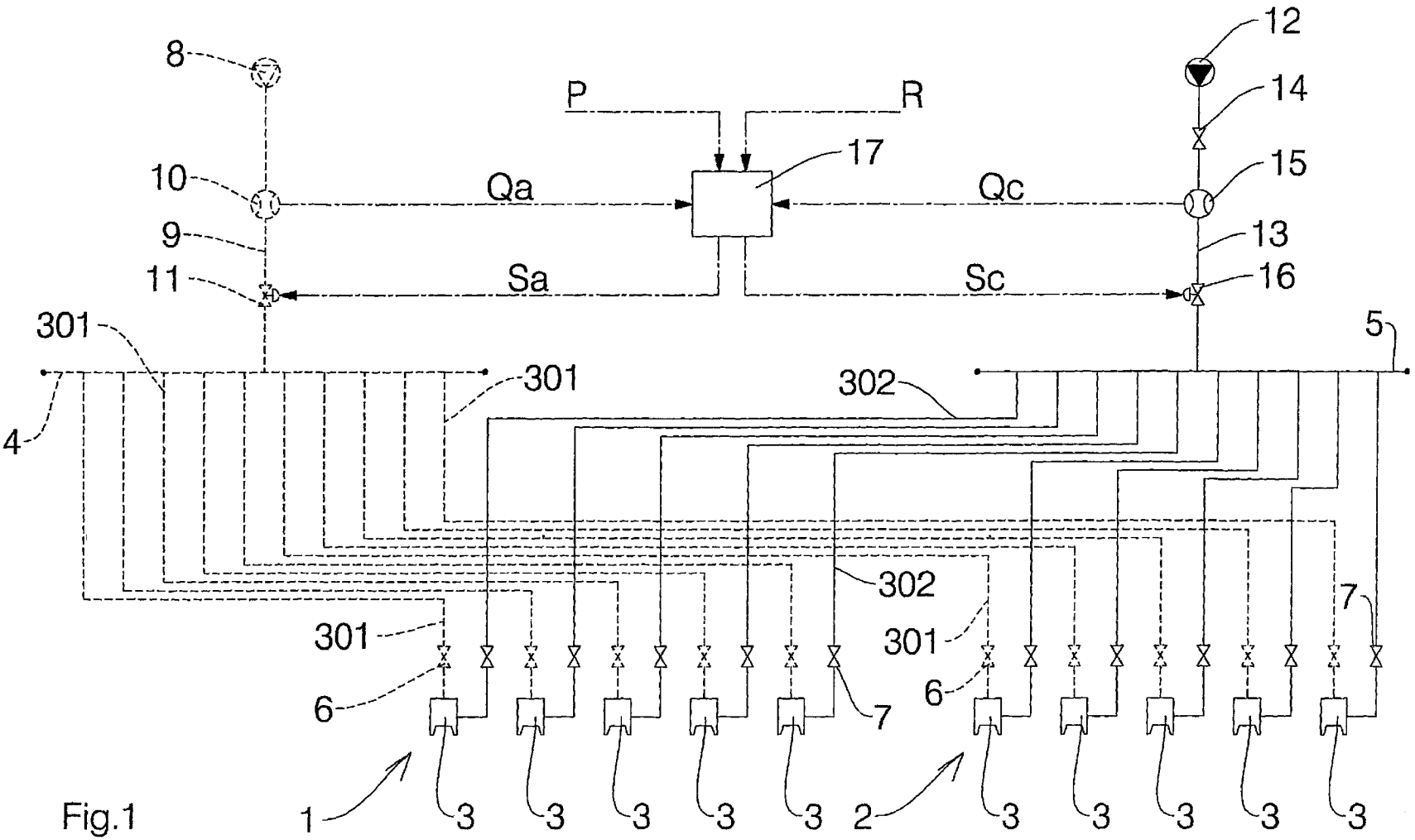

The present invention relates to a device for supplying fuel and comburent agent to at least two arrays of burners, in which each burner is connected to a fuel inlet line and to a comburent agent inlet line and these lines are connected by means of a corresponding manifold respectively to a fuel supply duct and to a comurent agent supply duct A device for this kind is known from the documents U.S. Pat. No. 4,043,742, 4,825,353A. 4,834,644A 3,760,775 a.

The function of the burners in heating furnaces is to raise a charge from a lower temperature at which it enters the furnace to a higher temperature at which it leaves the furnace, in order, for example, to heat and raise the temperature of a slab which is to be rolled on leaving the furnace. The charge is heated, as is known, by the transmission of the heat generated by the combustion products by processes of radiation and convection. Before its removal from the furnace, the charge is held in areas of the furnace having a lower temperature. The purpose is to keep the mean temperature reached during heating constant, thus keeping the non-uniformities of heating within tolerances acceptable for the final rolling. These areas are known as equalizing or soaking areas.

In these equalizing areas, in which the power required is lower than the maximum power, the operation of the burners of the array can be controlled by making each burner operate at a mean power of, for example, 30–40% of the maximum power, and therefore below the optimal operating range, or by igniting one or more burners of the array or arrays in rotation with an individual load as close as possible to the maximum.

The object of the present invention is to provide a device for supplying one or more arrays of burners which, if it is necessary to control the power to be supplied to the burners, makes it possible to predetermine, upstream of the array or arrays, the flows of fuel and comburent agent required for these burners, according to a specific fixed ratio of fuel to comburent agent and according to the power required by the furnace at a specific moment, thus making it unnecessary to control each individual burner.

This object is achieved by the present invention by means of a device according to the pre-characterizing part of the claim and characterized by the combination of the following features:

a) in the proximity of each burner in the corresponding fuel inlet line is provided a valve for shutting off the flow of fuel to the burner and in the corresponding comburent agent inlet line is provided a valve for shutting off the flow of comburent agent to the burner, b) in the fuel supply duct is provided a control valve for controlling the flow of fuel and upstream of this control valve is provided a device for measuring the flow of fuel, c) in the comburent agent supply duct is provided a control valve for controlling the flow of comburent agent and upstream of this control valve is provided a device for measuring the flow of comburent agent, d) the devices for measuring the flows of fuel and of comburent agent and the control valves are operatively connected to a programmable logic unit, which receives at its inputs the data from the devices for measuring the flow of fuel and the flow of comburent agent and the data relating to the power required by the arrays of burners, as well as the data relating to a predetermined value of the ratio between fuel and comburent agent, and supplies at its outputs signals for controlling the opening of the control valves in order to keep the ratio between the flow of fuel and the flow of comburent agent to the predetermined value, during the operation the valve provided in the fuel inlet line and the valve provided in the comburent agent inlet line corresponding to a part of the burners of each array of burners are closed, thus rendering inactive the respective part of burners.

By means of the present device, therefore, it is possible to allow the burners to operate, regardless of the power required for treating or heating a charge, in areas close to those of their optimal operation, and it is also possible, for situations in which the required power is less than the maximum, to make one or more burners of a specific array operate in rotation.

Further objects and advantages of the present invention will be understood more clearly from the following description, to be considered as an example without restrictive intent and with reference to the single attached drawing, in which:

FIG. 1 shows schematically a device according to the present invention for supplying two arrays of burners.

With reference to FIG. 1, two arrays 1 and 2, each comprising five burners 3, are schematically illustrated. Each of these burners 3 is provided with an inlet line 301 for the comburent agent, air for example, and an inlet line 302 for the fuel. These lines 301 and 302 are connected upstream of two manifolds 4 and 5 respectively for collecting the fuel and the comburent agent, and in the proximity of each burner 3 they have a valve 6 for shutting off the flow of comburent agent to the burner and a valve 7 for shutting off the flow of fuel to the burner. The circuits for the supply and control of the flows of fuel and comburent agent are provided upstream of the collecting manifolds 4 and 5. In the case of the comburent agent, this is introduced into the manifold 4 by means of a fan 8 which directs it into a supply duct 9 in which is provided a device 10 for measuring the flow and a valve 11 for controlling the flow. In the case of the fuel, this is introduced into the manifold 5 by means of a pump 12 which directs it into a supply duct 13 in which are provided a valve 14 for shutting off the flow of fuel, a device 15 for measuring the flow and a valve 16 for controlling the said flow. As can be seen, the diagram is completed by a central control unit 17 of the programmable logic type, which acquires and processes certain input data, principally the power P required by the burner arrays 1 and 2, the ratio R between the flow of fuel and the flow of comburent agent, the flow Qc of fuel, and the flow Qa of comburent agent; on the basis of these input data, the central unit 17 supplies at its output two signals Sa, Sc for the control valves.

During operation, therefore, the programmable logic unit 17 acquires the flows Qc and Qa by means of the corresponding measurement devices 15 and 10, and controls, by means of the signals Sc and Sa, the degree of opening of the control valves 16 and 11, taking into account the power P required and keeping the ratio R between the flow of fuel and the flow of comburent agent equal to a predetermined value. Thus the flows of fuel and comburent agent are controlled upstream of each individual burner and therefore, if the power required by the arrays is less than the maximum, it is advantageously possible to bring one or more of the burners of the array into operation, thus enable the burners to operate at all times in operating ranges close to those of optimal efficiency. For example, if each array 1 and 2 requires a power which can be produced by igniting two of the five burners 3, the valves 6 and 7 of two burners will be opened, and the burners will operate in the optimal efficiency range (in other words, close to the maximum power), and the valves of three burners will be closed so that these remain inactive. During the operating period of each array, it is also possible to ignite and extinguish two of the five burners in rotation, so that the charge is heated or treated in an efficient and uniform way.

What is claimed is:

1. Device for supplying fuel and comburent age to at least two arrays of burners, in which each burner is connected to a fuel inlet line and to a comburent agent inlet line, and these lines are connected by means of a corresponding manifold respectively to a fuel supply duct and to a comburent agent supply duct characterized by the combination of the following features:

a) in the proximity of each burner in the corresponding fuel inlet line is provided a valve for shutting off the flow of fuel to the burner and in the corresponding comburent agent inlet line is provided a valve for shutting off the flow of comburent agent to the burner, b) in the fuel supply duct is provided a control valve for controlling the flow of fuel and upstream of this control valve is provided a device for measuring the flow of fuel, c) in the comburent agent supply duct is provided a control valve for controlling the flow of comburent agent and upstream of this control valve is provided a device for measuring the flow of comburent agent, d) the devices for measuring the flows of fuel and of comburent agent and the control valves are operatively connected to a programmable logic unit which receives at its inputs the data from the devices for measuring the flow of fuel and the flow of comburent agent and the data relating to the power required by the arrays of burners, as well as the data relating to a predetermined value of the ratio between fuel and comburent agent, and supplies at its outputs signals for controlling the opening of the control valves in order to keep the ratio between the flew of fuel and the flow of comburent agent to the predetermined value e) during the operation the valve provided in the fuel inlet line and the valve provided in the comburent agent inlet line corresponding to a part of the burners of each array of burners are closed, thus rendering inactive the respective part of burners.

* * * * *